US007050726B2

(12) United States Patent
Adkins et al.

(10) Patent No.: US 7,050,726 B2
(45) Date of Patent: May 23, 2006

(54) METHOD FOR IMAGING WITH AN IMAGING APPARATUS THAT FACILITATES THE USE OF A STARTER CARTRIDGE

(75) Inventors: Christopher Alan Adkins, Lexington, KY (US); Jeffrey Ray Ehlert, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 151 days.

(21) Appl. No.: 10/877,101

(22) Filed: Jun. 25, 2004

(65) Prior Publication Data

US 2005/0286913 A1 Dec. 29, 2005

(51) Int. Cl.
*G03G 15/00* (2006.01)
*B41J 2/195* (2006.01)
*B41J 29/38* (2006.01)

(52) U.S. Cl. ..... 399/12; 347/7; 347/19

(58) Field of Classification Search ..... 399/12, 399/13; 347/7, 19
See application file for complete search history.

(56) References Cited

U.S. PATENT DOCUMENTS 5,627,572 A 5/1997 Harrington, III et al.
5,835,817 A * 11/1998 Bullock et al. ..... 347/19 X
6,024,429 A 2/2000 Coffy et al.
6,151,039 A 11/2000 Hmelar et al.
6,164,758 A 12/2000 Kretschmer
6,219,153 B1 4/2001 Kawanabe et al.
6,271,928 B1 * 8/2001 Bullock et al. ..... 347/19 X
6,290,321 B1 9/2001 Murray et al.
6,299,269 B1 * 10/2001 Davies et al. ..... 347/19 X
6,345,891 B1 * 2/2002 Childers et al. ..... 347/19 X
6,360,174 B1 3/2002 Shoki
6,435,676 B1 8/2002 Murray et al.
6,488,352 B1 12/2002 Helterline et al.
6,497,469 B1 12/2002 Shinada et al.
6,530,634 B1 3/2003 Hara
6,546,212 B1 * 4/2003 Ogata et al. ..... 399/12 X
2002/0070986 A1 6/2002 Marquis
2002/0118236 A1 8/2002 Uetsuki
2002/0126164 A1 9/2002 Walker et al.
2002/0167572 A1 11/2002 Heim et al.
2003/0063147 A1 * 4/2003 Walker ..... 347/19
2003/0071862 A1 4/2003 Tsukada et al.
2003/0081036 A1 5/2003 Hall
2003/0146945 A1 8/2003 Inui et al.
2004/0021722 A1 * 2/2004 Steinmetz et al. ..... 347/19

* cited by examiner

*Primary Examiner*—Sandra L. Brase
(74) *Attorney, Agent, or Firm*—Taylor & Aust, P.C.

(57) ABSTRACT

A method for imaging with an imaging apparatus includes the steps of designating a supply item for use in the imaging apparatus as one of a first cartridge type and a second cartridge type; establishing for the imaging apparatus a first operational state and a second operational state, the first operational state corresponding to a first period of imaging apparatus use when the imaging apparatus is new, and the second operational state corresponding to a second period of imaging apparatus use following the first period of imaging apparatus use; and determining whether the imaging apparatus is operating in the first operational state, the imaging apparatus accepting the first cartridge type for imaging only if the imaging apparatus is operating in the first operational state.

25 Claims, 2 Drawing Sheets

METHOD FOR IMAGING WITH AN IMAGING APPARATUS THAT FACILITATES THE USE OF A STARTER CARTRIDGE

BACKGROUND OF THE INVENTION

1. Field of the Invention

The present invention relates to imaging using a supply item containing an imaging substance, and, more particularly, to a method for imaging with an imaging apparatus that facilitates the use of a starter cartridge.

2. Description of the Related Art

An imaging apparatus, such as a printer or multifunction unit, is coupled to a supply item containing an imaging substance for forming an imaging on a print medium, such as paper or transparency. The imaging apparatus may be, for example, a printer, a copier or a multifunction unit. Such a printer may be, for example, an ink jet printer having an ink jet print engine, or an electrophotographic (e.g., laser) printer having an electrophotographic (EP) print engine. Such a multifunction unit may include an ink jet print engine and/or an EP print engine, and is configured to perform stand alone functions, such as copying or facsimile receipt and transmission, or may be connected to a host via a communications link to facilitate a printing function. The imaging substance may be, for example, ink or toner.

What is needed in the art is a method for imaging that facilitates the use of a starter cartridge in an imaging apparatus, such as for example, during a first period of imaging apparatus use when the imaging apparatus is considered new.

SUMMARY OF THE INVENTION

In one embodiment, the present invention provides a method for imaging that facilitates the use of a starter cartridge in an imaging apparatus, such as for example, during a first period of imaging apparatus use when the imaging apparatus is considered new.

The present invention, in one form thereof, is directed to a method for imaging with an imaging apparatus, including the steps of designating a supply item for use in the imaging apparatus as one of a first cartridge type and a second cartridge type; establishing for the imaging apparatus a first operational state and a second operational state, the first operational state corresponding to a first period of imaging apparatus use when the imaging apparatus is new, and the second operational state corresponding to a second period of imaging apparatus use following the first period of imaging apparatus use; and determining whether the imaging apparatus is operating in the first operational state, the imaging apparatus accepting the first cartridge type for imaging only if the imaging apparatus is operating in the first operational state.

In another form thereof, the present invention is directed to a method for imaging with an imaging apparatus, including the steps of designating a supply item for use in the imaging apparatus as one of a starter cartridge and a normal cartridge; establishing for the imaging apparatus a starter operational state and a normal operational state, the starter operational state corresponding to a first period of imaging apparatus use when the imaging apparatus is new, and the normal operational state corresponding to a second period of imaging apparatus use following the first period of imaging apparatus use; and determining whether the imaging apparatus is operating in the starter operational state, the imaging apparatus accepting the starter cartridge for imaging only if the imaging apparatus is operating in the starter operational state.

In still another form thereof, the present invention relates to an imaging apparatus, or an imaging system, including a print engine, and a controller communicatively coupled to the print engine. The controller is configured to perform the steps of determining whether the imaging apparatus is operating in a first operational state or a second operational state, the first operational state corresponding to a first period of imaging apparatus use when the imaging apparatus is new, and the second operational state corresponding to a second period of imaging apparatus use following the first period of imaging apparatus use; determining a type of imaging supply item loaded in the imaging apparatus; and imaging with a first type of the imaging supply item only if the imaging apparatus is operating in the first operational state.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION

Figure 1:
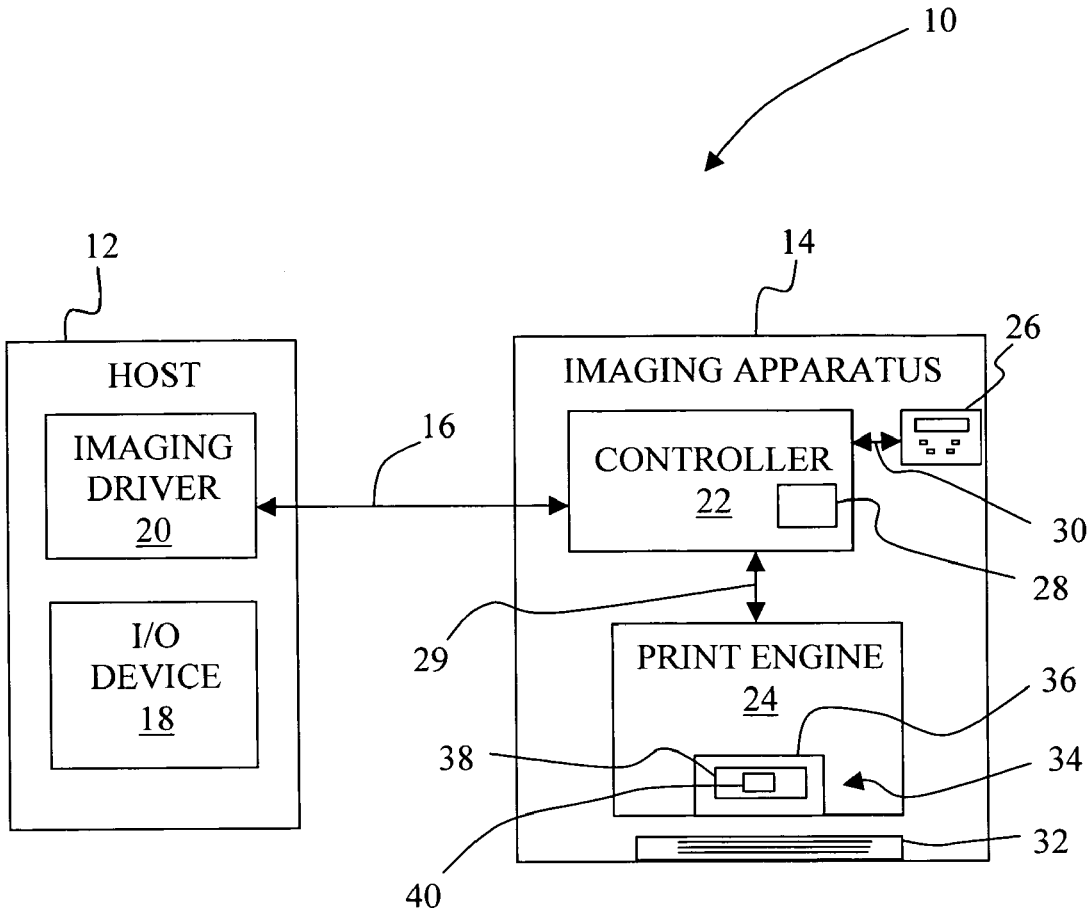
FIG. 1 is a diagrammatic representation of an imaging system embodying the present invention.

Referring now to the drawings, and particularly to FIG. 1, there is shown a diagrammatic depiction of an imaging system 10 embodying the present invention. Imaging system 10 may include a host 12 and an imaging apparatus 14, or alternatively, imaging system 10 may be a standalone system not attached to a host.

Host 12, which may be optional, may be communicatively coupled to imaging apparatus 14 via a communications link 16. Communications link 16 may be established, for example, by a direct cable connection, wireless connection or by a network connection such as for example an Ethernet local area network (LAN).

In embodiments including host 12, host 12 may be, for example, a personal computer including an input/output (I/O) device 18, such as keyboard and display monitor. Host 12 further includes a processor, input/output (I/O) interfaces, memory, such as RAM, ROM, NVRAM, and may include a mass data storage device, such as a hard drive, CD-ROM and/or DVD units. During operation, host 12 includes in its memory a software program including program instructions that function as an imaging driver 20, e.g., printer driver software, for imaging apparatus 14. Imaging driver 20 facilitates communication between host 12 and imaging apparatus 14, and may provide formatted print data to imaging apparatus 14.

Imaging apparatus 14 includes a controller 22, a print engine 24 and a user interface 26. Imaging apparatus 14 may be, for example, a printer or a multifunction unit. Such a printer may be, for example, an ink jet printer having an ink jet print engine, or an electrophotographic (e.g., laser) printer having an electrophotographic (EP) print engine. Such a multifunction unit may include an ink jet print engine and/or an EP print engine, and is configured to perform standalone functions, such as copying or facsimile receipt and transmission, or may be connected to host 12 via communications link 16 to facilitate a printing function.

Controller 22 includes a processor unit, memory 28 and associated interface circuitry, and may be formed as an Application Specific Integrated Circuit (ASIC). Controller 22 communicates with print engine 24 via a communications link 29. Controller 22 communicates with user interface 26 via a communications link 30. Communications links 29 and 30 may be established, for example, by using standard electrical cabling or bus structures, or by wireless connection.

In the context of the examples for imaging apparatus 14 given above, print engine 24 is configured to form an image, e.g., text and/or graphics, on a print medium 32, such as a sheet of paper, transparency or fabric. In embodiments including host 12, imaging driver 20 is in communication with controller 22 of imaging apparatus 14 via communications link 16, and may provide formatted print data to imaging apparatus 14, and more particularly, to print engine 24. Alternatively, however, all or a portion of imaging driver 20 may be incorporated into controller 22 of imaging apparatus 14. Likewise, all or a portion of controller 22 may be incorporated into host 12.

In accordance with one embodiment of the present invention, controller 22 is configured to control imaging apparatus 14 in a plurality of operational states, including a starter operational state and a normal operational state. The starter operational state corresponds to a first period of use of imaging apparatus 14 when imaging apparatus 14 is considered to be new. The normal operational state corresponds to a second period of use of imaging apparatus 14 following the first period of use of imaging apparatus 14. Thus, the starter operational state and the normal operational state may be delimited by a usage threshold for imaging apparatus 14, with the usage threshold stored in memory 28 of imaging apparatus 14.

For example, imaging apparatus 14 may be configured to track one or more usage events that relate to an amount of use of imaging apparatus 14. Such events may include tracking an amount of imaging substance consumed by imaging apparatus 14 (e.g., by an ink drop count), the number of images formed by imaging apparatus 14 (e.g., by an image count), and/or the number of sheets of print medium processed through imaging apparatus 14 (e.g., a page count). In any case, the usage threshold is set to a desired level of usage in terms of the event(s) being tracked, and will switch from the starter operational state to the normal operational state once controller 22 determines that the usage threshold has been reached.

As a more specific example, the usage threshold may be set such that imaging apparatus 14 remains in the starter operational state so long as one of a monochrome ink drop count and a color ink drop count has not satisfied a usage threshold condition, e.g., one of the monochrome ink drop count and the color ink drop count is less than the usage threshold. Further, imaging apparatus 14 may be configured via controller 22, for example, to only use a predetermined type of imaging substance supply item during the starter operational state and/or the normal operational state.

Associated with imaging apparatus 14 is a supply item 34, such as for example an ink jet printhead cartridge or an EP cartridge. Supply item 34 is received into print engine 24. It is contemplated that imaging apparatus 14 may simultaneously accommodate multiple supply items 34, but for ease of discussion and understanding of the invention, a single supply item 34 is discussed below.

Supply item 34 includes an imaging substance reservoir 36 for holding a supply of imaging substance, such as one or more colors of ink or toner, e.g., monochrome (black), cyan, magenta and/or yellow, and/or diluted forms thereof. For example, in embodiments where print engine 24 is an ink jet print engine, then the imaging substance is ink. In embodiments wherein print engine 24 is an EP print engine, then the imaging substance is toner, which may be in dry or liquid form.

Figure 2:
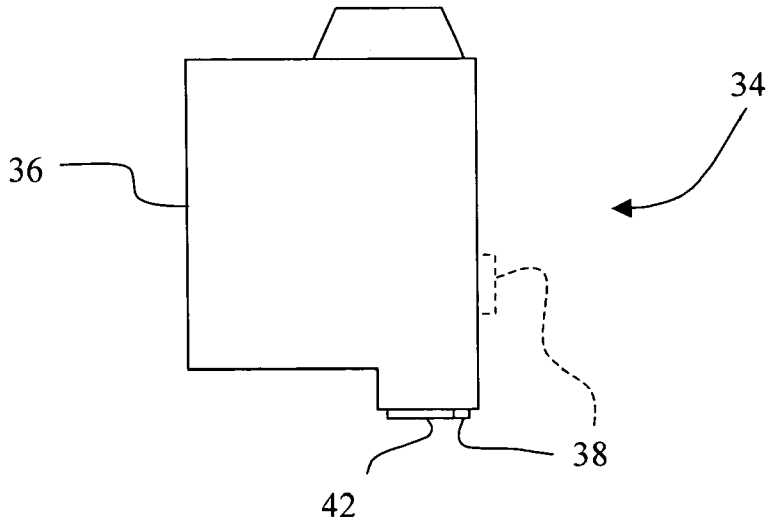
FIG. 2 is a diagrammatic representation of an exemplary supply item configured in accordance with the present invention.

Supply item 34 also includes an electronic circuit 38, including memory 40 and interface circuitry for facilitating communications with controller 22. FIG. 2 shows an exemplary embodiment of supply item 34 in the form of an ink jet printhead cartridge, wherein electronic circuit 38 may be formed as a part of the silicon on which a printhead 42 is formed. As an alternative to including electronic circuit 38 on the silicon of printhead 42, electronic circuit 38 may be separately affixed to supply item 34, such as by attachment to imaging substance reservoir 36, as shown by dashed lines.

Supply item 34 may be configured to be one of a plurality of cartridge types, such as for example, one of a starter cartridge and a normal cartridge. For example, as a starter cartridge, supply item 34 may be intended to be used in imaging apparatus 14 only during the starter operational state. One example of why imaging apparatus 14 may be configured such that the starter cartridge may only be used during the starter operational state would be to provide a special promotional cartridge for use when imaging apparatus 14 is new. Another example of why imaging apparatus 14 may be configured such that the starter cartridge may only be used during the starter operational state would be to facilitate a desired break-in period for imaging apparatus 14.

Supply item 34 may be configured as one of a starter cartridge and a normal cartridge by setting a predefined bit, or bits, in memory 40 of electronic circuit 38 attached to supply item 34. When supply item 34 is installed in imaging apparatus 14, controller 22 then will read memory 40 of supply item 34 to determine whether supply item 34 is a starter cartridge or a normal cartridge.

Figure 3:
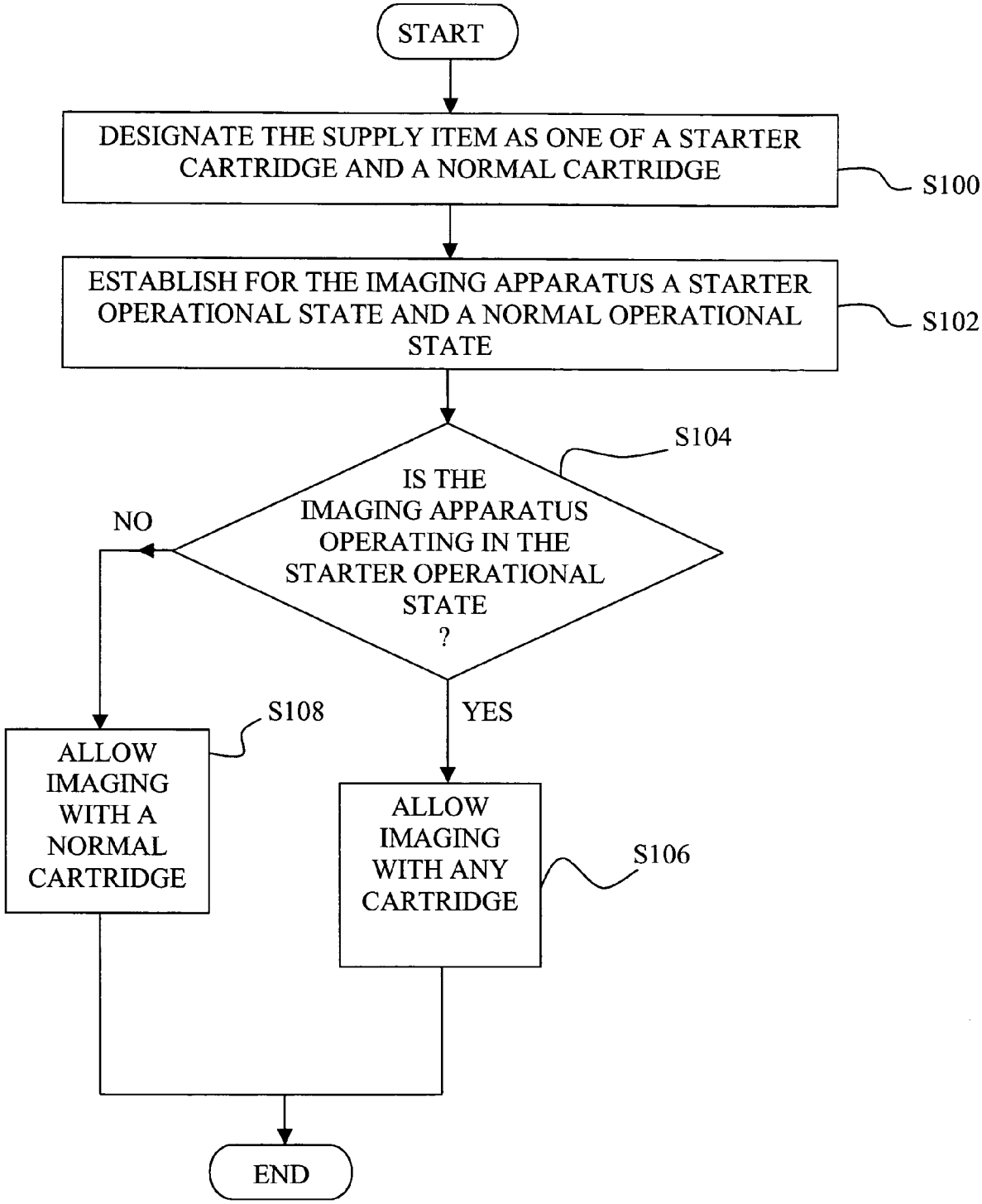
FIG. 3 is a flowchart of a general method for imaging with an imaging apparatus, in accordance with the present invention.

FIG. 3 is a flowchart of a general method for imaging with imaging apparatus 14, in accordance with the present invention.

At step S100, supply item 34 is designated for use in imaging apparatus 14 as one of a starter cartridge and a normal cartridge. Such a determination may be made, for example, during the manufacture of supply item 34. For example, one bit in memory 40 of supply item 34 may be set to a logical "1" condition to designate supply item 34 as a starter cartridge, or may be set at a logic "0" condition to designate supply item 34 as a normal cartridge.

At step S102, established for imaging apparatus 14 is a starter operational state and a normal operational state, such as for example, by the program configuration established in controller 22. The starter operational state might correspond to a first period of imaging apparatus use when imaging apparatus 14 is considered new, and the normal operational state corresponds to a second period of imaging apparatus use following the first period of imaging apparatus use. This establishing step may be effected, for example, by defining a usage threshold for imaging apparatus 14 to delimit the starter operational state and the normal operational state, with the usage threshold being stored, for example, in memory 28 of imaging apparatus 14.

At step S104, controller 22 determines whether imaging apparatus 14 is operating in the starter operational state. This determination may be made, for example, by comparing the usage threshold with a tracked usage indicator, such as an amount of imaging substance consumed by imaging apparatus 14 (e.g., by a ink drop count), the number of images formed by imaging apparatus 14, and/or the number of sheets of print medium processed through imaging apparatus 14.

If the determination at step S104 is YES, then at step S106 imaging apparatus 14 allows normal imagining operations to continue.

If the determination at step S104 is NO, then imaging apparatus 14 is operating in the normal operational state.

Accordingly, at step S108, if controller 22 of imaging apparatus 14 reads memory 40 of supply item 34 and determines that supply item 34 is a normal cartridge, then normal imaging operations continue. Thus, imaging apparatus 14 may be configured to accept the starter cartridge for imaging if imaging apparatus 14 is operating in the starter operational state. If it is determined that a starter cartridge is loaded, but imaging apparatus 14 is in the normal operating state, then the user may, for example, be prompted by user interface 26 of imaging apparatus 14, or alternatively by host 12, to, for example, install a supply item 34 that has a normal cartridge configuration.

While this invention has been described with respect to embodiments of the invention, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A method for imaging with an imaging apparatus, comprising the steps of:

designating a supply item for use in said imaging apparatus as one of a first cartridge type and a second cartridge type;

establishing for said imaging apparatus a first operational state and a second operational state, said first operational state corresponding to a first period of imaging apparatus use when said imaging apparatus is new, and said second operational state corresponding to a second period of imaging apparatus use following said first period of imaging apparatus use; and determining whether said imaging apparatus is operating in said first operational state, said imaging apparatus accepting said first cartridge type for imaging only if said imaging apparatus is operating in said first operational state.

2. The method of claim 1, said first operational state and said second operational state being delimited by an imaging apparatus usage threshold.

3. The method of claim 2, said usage threshold relating to one of an ink drop count, an image count and a page count.

4. The method of claim 2, said usage threshold being set such that said imaging apparatus remains in said first operational state so long as one of a monochrome ink drop count and a color ink drop count has not satisfied a usage threshold condition.

5. The method of claim 1, wherein said imaging apparatus includes an ink jet print engine, and said supply item is a printhead cartridge.

6. The method of claim 1, wherein said imaging apparatus includes an electrophotographic (EP) print engine, and said supply item is an EP cartridge.

7. The method of claim 1, wherein said first cartridge type is a starter cartridge.

8. The method of claim 1, wherein said second cartridge type is a normal cartridge.

9. A method for imaging with an imaging apparatus, comprising the steps of:

designating a supply item for use in said imaging apparatus as one of a starter cartridge and a normal cartridge;

establishing for said imaging apparatus a starter operational state and a normal operational state, said starter operational state corresponding to a first period of imaging apparatus use when said imaging apparatus is new, and said normal operational state corresponding to a second period of imaging apparatus use following said first period of imaging apparatus use; and determining whether said imaging apparatus is operating in said starter operational state, said imaging apparatus accepting said starter cartridge for imaging only if said imaging apparatus is operating in said starter operational state.

10. The method of claim 9, said starter operational state and said normal operational state being delimited by an imaging apparatus usage threshold.

11. The method of claim 10, said usage threshold relating to one of an ink drop count, an image count and a page count.

12. The method of claim 10, said usage threshold being set such that said imaging apparatus remains in said starter operational state so long as one of a monochrome ink drop count and a color ink drop count has not satisfied a usage threshold condition.

13. The method of claim 9, wherein said imaging apparatus includes an ink jet print engine, and said supply item is a printhead cartridge.

14. The method of claim 9, wherein said imaging apparatus includes an electrophotographic (EP) print engine, and said supply item is an EP cartridge.

15. An imaging apparatus, comprising:

a print engine; and a controller communicatively coupled to said print engine, said controller being configured to perform the steps of:

determining whether said imaging apparatus is operating in a first operational state or a second operational state, said first operational state corresponding to a first period of imaging apparatus use when said imaging apparatus is new, and said second operational state corresponding to a second period of imaging apparatus use following said first period of imaging apparatus use;

determining a type of imaging supply item loaded in said imaging apparatus; and imaging with a first type of said imaging supply item only if said imaging apparatus is operating in said first operational state.

16. The imaging apparatus of claim 15, wherein said first type of said imaging supply item is a starter cartridge.

17. The imaging apparatus of claim 15, said first operational state and said second operational state being delimited by an imaging apparatus usage threshold.

18. The imaging apparatus of claim 17, said usage threshold relating to one of an ink drop count, an image count and a page count.

19. The imaging apparatus of claim 17, said usage threshold being set such that said imaging apparatus remains in said first operational state so long as one of a monochrome ink drop count and a color ink drop count has not satisfied a usage threshold condition.

20. An imaging system including an imaging apparatus, comprising:

a print engine; and a controller communicatively coupled to said print engine, said controller being configured to perform the steps of:

determining whether said imaging apparatus is operating in a first operational state or a second operational state, said first operational state corresponding to a first period of imaging apparatus use when said imaging apparatus is new, and said second operational state corresponding to a second period of imaging apparatus use following said first period of imaging apparatus use;

determining a type of imaging supply item loaded in said imaging apparatus; and imaging with a first type of said imaging supply item only if said imaging apparatus is operating in said first operational state.

21. The imaging system of claim 20, wherein said first type of said imaging supply item is a starter cartridge.

22. The imaging system of claim 20, said first operational state and said second operational state being delimited by an imaging apparatus usage threshold.

23. The imaging system of claim 22, said usage threshold relating to one of an ink drop count, an image count and a page count.

24. The imaging system of claim 22, said usage threshold being set such that said imaging apparatus remains in said first operational state so long as one of a monochrome ink drop count and a color ink drop count has not satisfied a usage threshold condition.

25. The imaging system of claim 20, said controller being incorporated into at least one of a host and said imaging apparatus that contains said print engine.

* * * * *